US006047616A

United States Patent [19]

Ochiai

[11] Patent Number: 6,047,616

[45] Date of Patent: Apr. 11, 2000

[54] SCREW-ROTATING TOOL

[76] Inventor: Hiroshi Ochiai, 358-4, Oaza Nakamachi, Seki-cho, Suzuka-gun, Mie, Japan

[21] Appl. No.: 09/227,828

[22] Filed: Jan. 11, 1999

[30] Foreign Application Priority Data

Jan. 10, 1998 [JP] Japan ..... 10-015018
Jun. 22, 1998 [JP] Japan ..... 10-192474

[51] Int. Cl.[7] ..... B25B 17/00

[52] U.S. Cl. ..... 81/57.29; 81/57.13; 81/58

[58] Field of Search ..... 81/57, 57.13, 57.28, 81/57.29, 58

[56] References Cited

U.S. PATENT DOCUMENTS 4,474,089 10/1984 Scott ..... 81/57.29
4,532,832 8/1985 Christensen ..... 81/57.29
4,762,031 8/1988 Bradley ..... 81/57.22

FOREIGN PATENT DOCUMENTS 8-141921 6/1996 Japan .

*Primary Examiner*—James G. Smith
*Assistant Examiner*—David B. Thomas
*Attorney, Agent, or Firm*—McDermott, Will & Emery

[57] ABSTRACT

Merely a handle-rotating operation allows a screw part such as a bolt or a nut to be tightened or loosened without rotating the screw part when the handle is rotated in a reverse direction. A screw-rotating tool comprising a main section having a first reverse rotation prevention mechanism provided on a periphery of a main rotary body having a socket part which is formed on one end thereof and engaging a screw part; and an auxiliary section including an auxiliary rotary body having a second reverse rotation prevention mechanism formed on a periphery thereof and engaging the main rotary body and a handle which operates the second reverse rotation prevention mechanism. The construction allows the screw part engaging the socket part to be rotated in one direction by operating the handle.

6 Claims, 14 Drawing Sheets

SCREW-ROTATING TOOL

BACKGROUND OF THE INVENTION

1. Field of the Invention

The present invention relates to a screw-rotating tool to be used to tighten or loosen screw parts such as bolts, nuts, and the like.

2. Description of the Related Art

A tightening means using screw parts such as bolts, nuts, and the like is widely used nowadays because it is convenient and secures strength. Although spanners, monkey wrenches, and the like are used to tighten or loosen the screw parts, a ratchet tool incorporating a ratchet mechanism is superior to them because the ratchet tool can be used conveniently.

As shown in FIG. 19, in the ratchet tool, a handle (a) is pivoted within a predetermined angle. As a result, a click (b) rotates a ratchet wheel (c), and a socket (d) integral with the ratchet wheel (c) can be rotated in one direction. An engaging portion (e) of the ratchet tool engaging a screw part is formed on the inner peripheral surface of the socket (d). An urging spring (f) is installed proximately to the click (b). Accordingly, it is possible to tighten or loosen the screw part easily by engaging the socket (d) with the screw part only once in the socket (d), unlike a spanner which requires a worker to engage the socket (d) with the screw part repeatedly.

However, the ratchet tool has a limited operable range: When the resistance between a female screw and a bolt becomes smaller than that between the ratchet wheel and the click in loosening the bolt, the bolt is rotated even by reverse pivotal motions (tightening direction) of the handle, with the ratchet mechanism being unoperative. A similar situation occurs in an initial stage to an intermediate stage in a bolt-tightening operation. Thus, the ratchet tool is not useful except the final stage in the bolt-tightening operation.

In order to overcome such a problem, there is disclosed in Japanese Laid-Open Patent Publication No. 8141921 an art of installing a hand ring on the periphery of the socket of the ratchet tool. The hand ring is rotated to tighten or loosen the bolt when the resistance between the female screw and the bolt becomes small. The operation of rotating the hand ring is troublesome.

SUMMARY OF THE INVENTION

It is an object of the present invention to provide a screw-rotating tool capable of tightening or loosening a screw part such as a bolt or a nut throughout the screw-tightening or screw-loosening operation by merely rotating a handle thereof, without rotating the screw part when the handle is rotated in a reverse direction.

In order to achieve the object, there is provided a screw-rotating tool comprising a main section having a first reverse rotation prevention mechanism provided on a periphery of a main rotary body having a socket part which is formed on one end thereof and engaging a screw part; and an auxiliary section including an auxiliary rotary body having a second reverse rotation prevention mechanism formed on a periphery thereof and engaging the main rotary body and a handle which operates the second reverse rotation prevention mechanism. The construction allows the screw part engaging the socket part to be rotated in one direction by operating the handle.

According to the screw-rotating tool of the present invention, the first reverse rotation prevention mechanism and the second reverse rotation prevention mechanism operate independently of each other. Therefore, merely a handle-rotating operation allows the screw part such as a bolt or a nut to be tightened or loosened easily and reliably, without rotating the screw part when the handle is rotated in a reverse direction. Thus, the screw-rotating tool of the present invention is very effective for improving operability.

Further objects and advantages of the present invention will be apparent from the following detailed description, reference being made to the accompanying drawings, wherein preferred embodiments of the present invention are clearly shown.

DETAILED DESCRIPTION OF THE PREFERRED EMBODIMENTS

Figure 1:
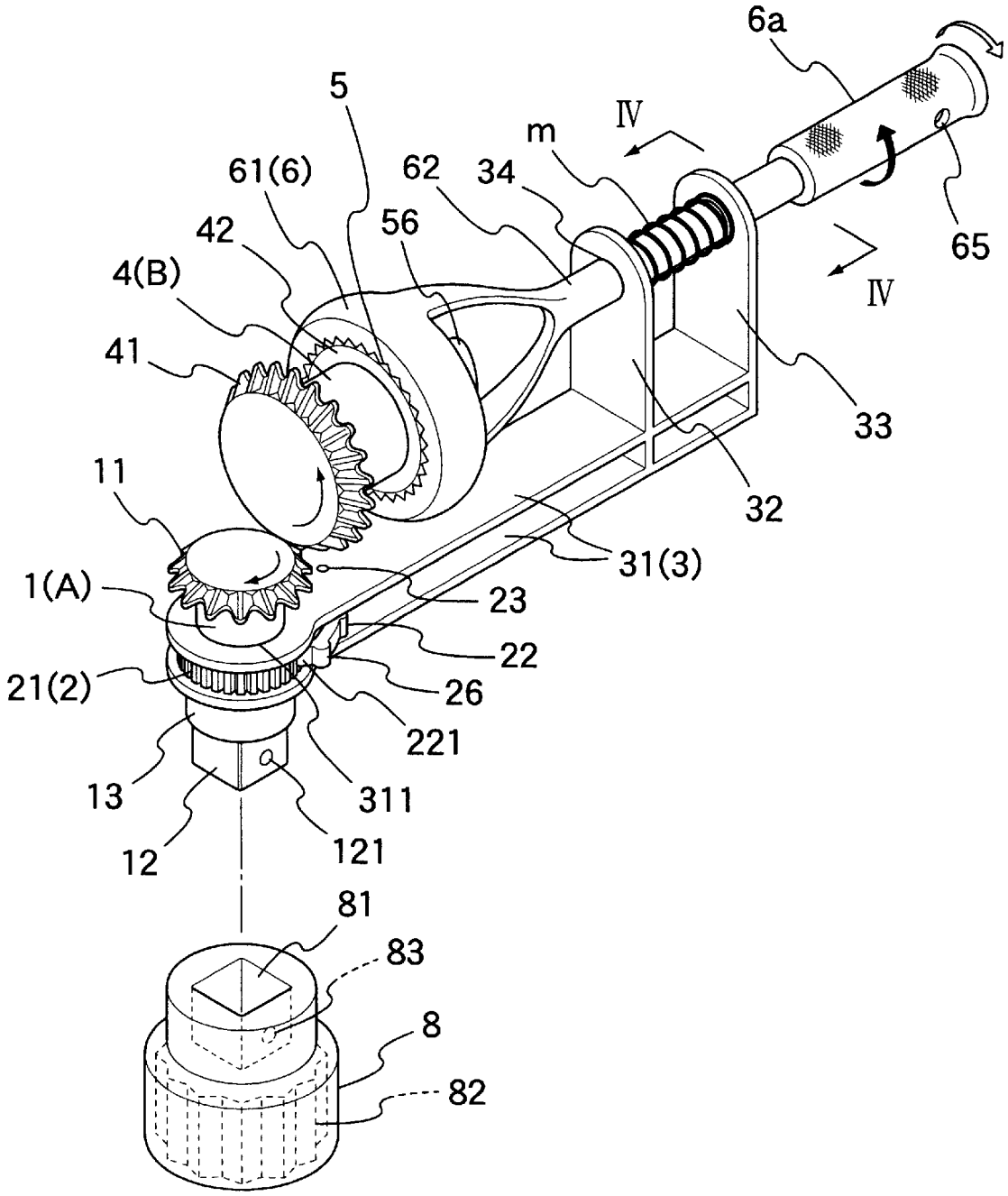
FIG. 1 is a perspective view showing a screw-rotating tool according to an embodiment 1 of the present invention.

The screw-rotating tool according to each of the embodiments of the present invention will be described below with reference to the drawings.

(1) Embodiment 1

FIGS. 1 through 7 show a screw-rotating tool according to the embodiment 1 of the present invention.

The screw-rotating tool (ratchet tool) comprises a main section (A), an auxiliary section (B), a frame 3, and a compression coil spring (m). The main section (A) has a main rotary body 1 and a first ratchet mechanism 2.

A socket part 8 engaging a screw part is formed on one end of the main rotary body 1. The columnar (cylindrical) main rotary body 1 has at its upper end an engaging member (bevel wheel (gear) 11) engaging an auxiliary rotary body 4 of the auxiliary section (B) and a rectangular pillar-shaped insertion part 12 formed at its lower end to install the socket part 8 thereon removably. There is formed a small projection 121 which projects outward from the insertion part 12 when it is elastically urged. To lock the socket part 8 to the insertion part 12, the insertion part 12 is inserted into a rectangular hole 81, and the small projection 121 is fitted into a concave portion 83 of the socket part 8. In the embodiment 1, the socket part 8 is separate from the main rotary body 1. This is because it is possible to provide the socket part 8 having an engaging portion 82 of different sizes according to sizes of the screw part. But it is possible to form the socket part 8 integrally with the main rotary body 1. "The socket part 8 is formed on the main rotary body 1" includes the case in which the socket part 8 is installed on the main rotary body 1 and the case in which the socket part 8 is formed integrally with the main rotary body 1.

A first reverse rotation prevention mechanism 2 is formed on the periphery of a columnar drum part 13 of the main rotary body 1.

The first reverse rotation prevention mechanism 2 consisting of the ratchet mechanism serves as a means for limiting clockwise and counterclockwise rotations of the main rotary body 1 to either the clockwise rotation or the counterclockwise rotation. The first ratchet mechanism 2 has the known construction, thus having a ratchet wheel (gear) 21 and a click 22. The ratchet wheel 21 is fixed to the periphery of the drum part 13 of the main rotary body 1.

Figure 3:
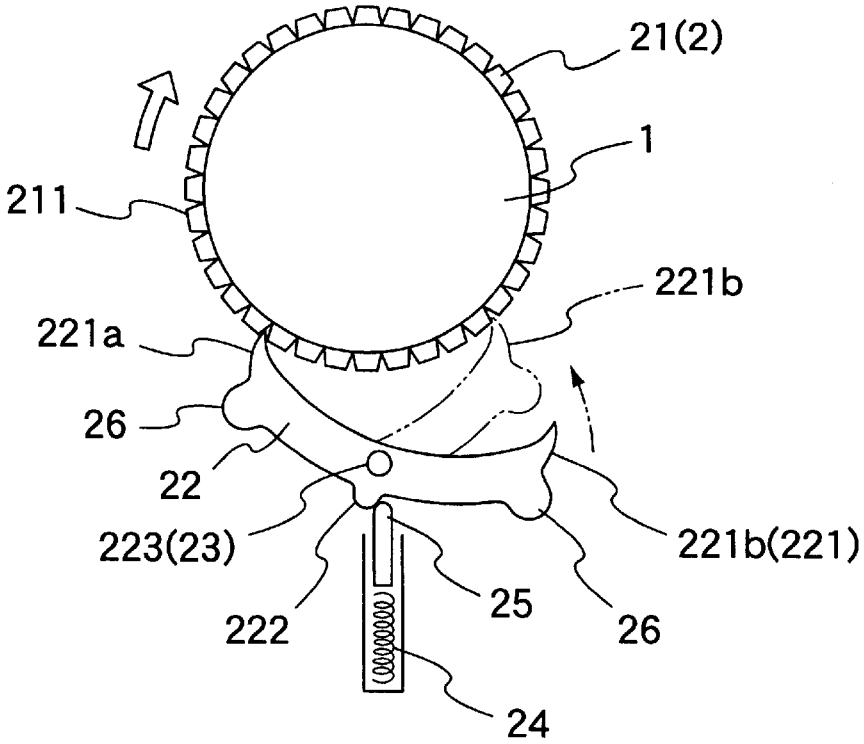
FIG. 3 is an explanatory view showing a ratchet mechanism.

The click 22 has a pawl 221 which engages teeth 211 (see FIG. 3) of the ratchet wheel 21 to rotate the ratchet wheel 21 in only one direction. As shown in FIG. 3, the click 22 of the embodiment 1 has pawls 221*a* and 221*b* formed at left and right sides of a circular arc-shaped plate and a projection 222 formed at its center. The click 22 has a hole 223 formed at its center and is installed on the frame 3 such that the click 22 is rotatable on a supporting shaft 23 inserted through the hole 223. Urged by a coil spring 24, a pin 25 forces the pawl 221*a* of the click 22 at the left side in FIG. 3 to engage the ratchet wheel 21.

In the state shown in FIG. 3, the ratchet wheel 21 rotates only clockwise (white arrow of FIG. 3). When the ratchet wheel 21 rotates clockwise, the click 22 slides on the teeth 211 of the ratchet wheel 21. In this state, the ratchet wheel 21 is prevented from rotating counterclockwise because the click 22 locks the ratchet wheel 21. To rotate the ratchet wheel 21 counterclockwise, a knob 26 is operated to place the pawl 221*b* at the position shown with a two-dot chain line of FIG. 3. The first reverse rotation prevention mechanism 2 and a second reverse rotation prevention mechanism 5 (which will be described later) serve as the means for rotating the main rotary body 1 and the second rotary body 4 in only one direction, namely, in a clockwise rotational direction or a counterclockwise rotational direction. Thus, herein, the reverse rotation prevention mechanism is used as concept including a ratchet mechanism and a one-way clutch.

Figure 2:
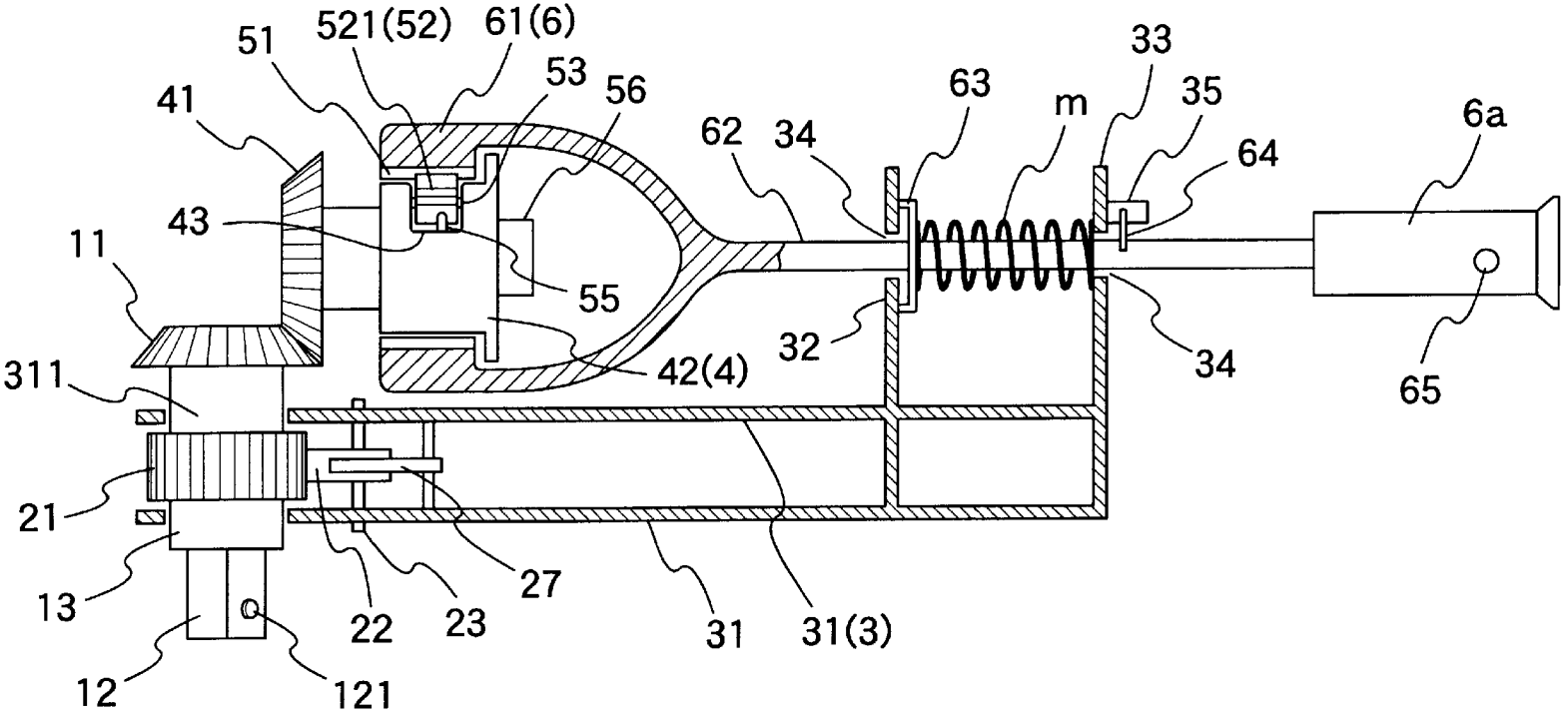
FIG. 2 is a front view partly in section showing the screw-rotating tool shown in FIG. 1.

As shown in FIG. 1, the plate-shaped frame 3 supports the main rotary body 1 rotatably inserted therethrough at one end thereof (left side or front side in FIG. 2). The frame 3 also supports a shaft part 62 of a handle 6 of the auxiliary section (B) at the other side thereof (right side of FIG. 2), with the shaft part 62 of the handle 6 inserted through the frame 3 at the right side thereof.

More specifically, a plate member 31 of the frame 3 supports the main rotary body 1 inserted through a circular hole 311 formed at the front side thereof. A pair of the plates 31 and 31 sandwiching the ratchet wheel 21 of the first ratchet mechanism 2 supports the main rotary body 1. The supporting shaft 23 (see FIG. 3) of the click 22 is installed on the plate member 31 to operate the first ratchet mechanism 2.

Two erected portions 32 and 33 are formed at a predetermined interval at the base side (right side in FIG. 2) of a pair of the plates 31 of the frame 3. A hole 34 is formed at an upper portion of each of the erected portions 32 and 33 to insert the shaft part 62 of the auxiliary section (B) therethrough.

The auxiliary section (B) comprises the auxiliary rotary body 4, the second ratchet mechanism 5, and the handle 6. In the embodiment 1, the auxiliary rotary body 4 and the handle 6 are coaxial with each other.

Similarly to the main rotary body 1, the auxiliary rotary body 4 consists of a columnar body and has a bevel wheel 41 (engaging member) formed on its head to engage the bevel wheel 41 with the main rotary body 1. More specifically, the bevel wheel 41 engages the bevel wheel 11 of the main rotary body 1, thus transmitting the rotary motion of the auxiliary rotary body 4 to the main rotary body 1 through the bevel wheel 11. That is, the bevel wheels 11 and 41 constitute a rotation transmission mechanism transmitting the rotary motion of the auxiliary rotary body 4 to the main rotary body whose the rotational axis extends in a direction different from the extension direction of the main rotary body. In the embodiment 1, the rotational axis of the main rotary body 1 and that of the auxiliary rotary body 4 are perpendicular to each other (see FIG. 2) to facilitate the operation of rotating the handle 6.

The bevel wheel 41 of the auxiliary rotary body 4 and the bevel wheel 11 of the main rotary body 1 may have the same number of teeth. But in the embodiment 1, it is preferable to set the number of teeth of the bevel wheel 41 of the auxiliary rotary body 4 larger than that of the bevel wheel 11 of the main rotary body 1 (see FIG. 7). In tightening the screw part, it can be rotated by applying a small force to a gripping part 6*a* of the handle 6 except the final stage of the tightening operation. Similarly, in loosening the screw part, it can be rotated without applying a great force to the gripping part 6*a* of the handle 6 except the initial stage of the loosening operation. It is possible to allow the number of rotations of the main rotary body 1 to be larger than that of the handle 6 by setting the number of teeth of the bevel wheel 41 of the auxiliary rotary body 4 larger than that of the bevel wheel 11 of the main rotary body 1. Thus, it is possible to rotate the screw part efficiently and quickly except the final and initial stages in which a great force is required to be applied to the gripping part 6*a*. The bevel wheels 11 and 41 are used as the rotation transmission mechanism in the embodiment 1. But instead, rubber can be used as the rotation transmission mechanism. This is because rubber can transmit the rotary motion of the auxiliary rotary body 4 to the main rotary body 1 without applying a great force to the rotation transmission mechanism. For example, it is possible to use a pair of umbrella-shaped rubber members whose heads are tapered. They can be engaged each other to transmit the rotary motion of the auxiliary rotary body 4 to the main rotary body 1 by means of the frictional force thereof. It is favorable to attach a material increasing the frictional force thereof to the engaging surface of each of a pair of the umbrella-shaped rubber members.

The second reverse rotation prevention mechanism 5 is provided on the periphery of the columnar drum part 42 of the auxiliary rotary body 4.

The second reverse rotation prevention mechanism consists of a ratchet mechanism. The second ratchet mechanism 5 serves as a means for limiting the rotational direction (clockwise and counterclockwise) of the gripping part 6*a* to the clockwise or counterclockwise rotational direction of the main rotary body 1 set by the first ratchet mechanism 2 when the rotation of the gripping part 6*a* is transmitted to the main rotary body 1. The second ratchet mechanism 5 has also the known construction, thus having a ratchet wheel 51 and a click 52. The click 52 is installed on the auxiliary rotary body 4. The ratchet wheel 51 is installed on the handle 6 supporting the auxiliary rotary body 4.

Figure 4:
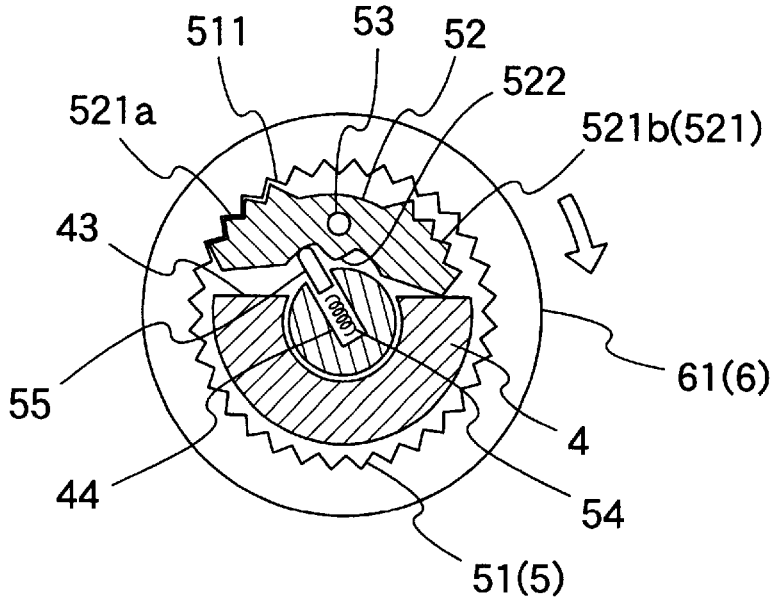
FIG. 4 is an explanatory view showing another ratchet mechanism.
Figure 5:
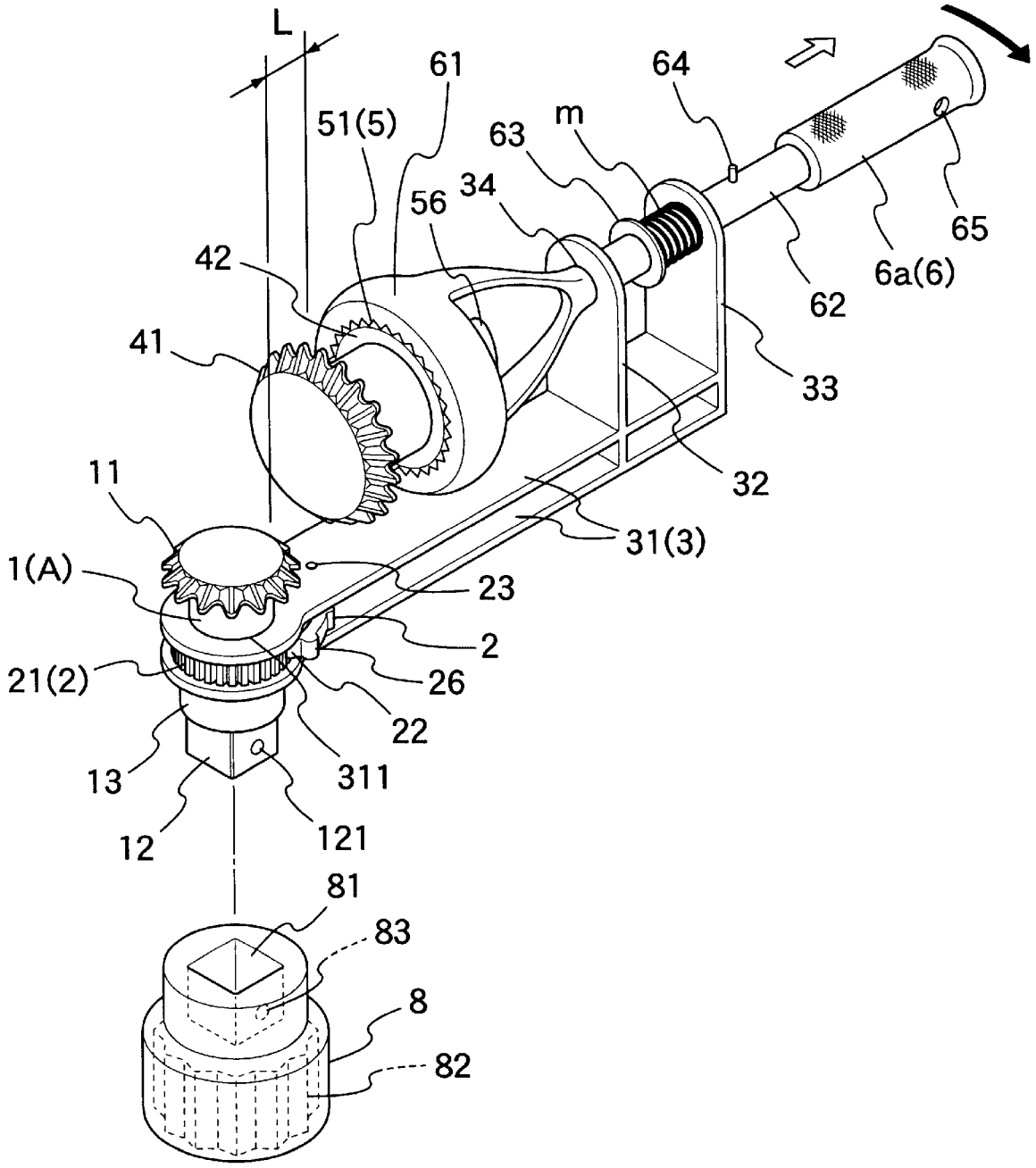
FIG. 5 is a perspective view showing the screw-rotating tool shown in FIG. 1 in the state in which a shaft part thereof is pulled rearward.

More specifically, as shown in FIGS. 4 and 5, the front end of the handle 6 is denoted as a cylindrical part 61 into which the drum part 42 of the auxiliary rotary body 4 is inserted. Teeth 511 is formed on the inner periphery of the cylindrical part 61 to form the ratchet wheel 51. A part of the drum part 42 of the auxiliary rotary body 4 is cut out radially. The circular arc-shaped click 52 is installed on the auxiliary rotary body 4 such that the click 52 is rotatable on a shaft 53. A pawl 521 formed at one end of the click 52 is brought into contact with the ratchet wheel 51 by a pin 55 urged by a spring 54 installed on a hole 44 formed on a cut-out surface 43 of the auxiliary rotary body 4.

In the state shown in FIG. 4, the auxiliary rotary body 4 is allowed to rotate only clockwise. When the handle 6 (cylindrical part 61) is rotated clockwise, as shown with an arrow of FIG. 4, the auxiliary rotary body 4 rotates clockwise together with the handle 6, with a pawl 521 locking the ratchet wheel 51. On the other hand, when the handle 6 rotates counterclockwise, the pawl 521*a* slides on the tooth surface 511 of the ratchet wheel 51. Thus, the ratchet wheel 51, namely, the handle 6 idles.

Needless to say, when a change-over knob 56 is operated to move the pin 55 past a projection 522 of the click 52, a pawl 521*b* located at the right side in FIG. 4 contacts the ratchet wheel 51. As a result, the auxiliary rotary body 4 is rotatable counterclockwise.

The cylindrical part 61 is formed on the front end of the rod-shaped handle 6, as shown in FIG. 1. The shaft part 62 extending rearward from the bifurcate part of the cylindrical part 61 is inserted through the erected portions 32 and 33 of the frame 3 so that the handle 6 on which the auxiliary rotary body 4 and the second ratchet mechanism 5 are installed is rotatably supported by the frame 3. The extension direction of the rotational axis of the handle 6 is set to be different from that of the rotational axis of the main rotary body 1. When the handle 6 is rotated within a certain angle, the second ratchet mechanism 5 serving as the second reverse rotation prevention mechanism operates, thus rotating the auxiliary rotary body 4 in only one direction. The rotation of the auxiliary rotary body 4 in one direction allows the main rotary body 1 to rotate in only one direction through the bevel wheels 41 and 11 serving as the rotation transmission mechanism and through the first ratchet mechanism 2.

As shown in FIG. 2, a flange 63 is fixed to the shaft part 62 of the handle 6 at a position in the range between the erected portions 32 and 33. A compression coil spring (m) consisting of an elastic material is also installed on the shaft part 62 at a position in the range between the flange 63 and the erected portion 33. The compression coil spring (m) urges the flange 63 to contact it with the erected portion 32. As a result, the bevel wheel 41 of the auxiliary rotary body 4 installed inside the cylindrical part 61 engages the bevel wheel 11 of the main rotary body 1. When the gripping part 6*a* located at the rear side of the handle 6 is pulled in the direction shown with a white arrow of FIG. 5, it is possible to disengage the bevel wheel 41 from the bevel wheel 11 against the urging force of the compression coil spring (m).

Figure 6:
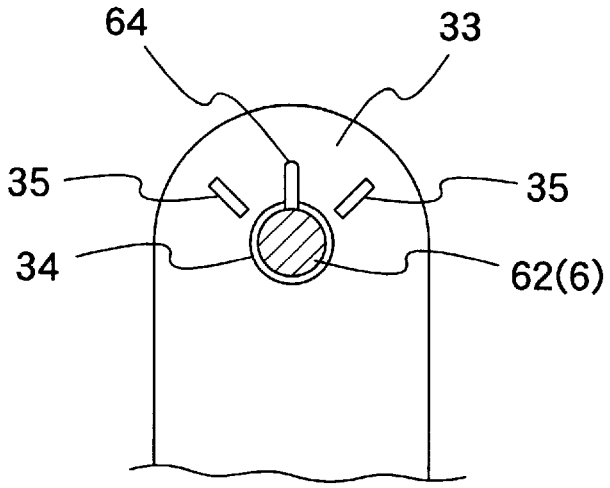
FIG. 6 is a sectional view taken along a line IV—IV of FIG. 1.
Figure 7:
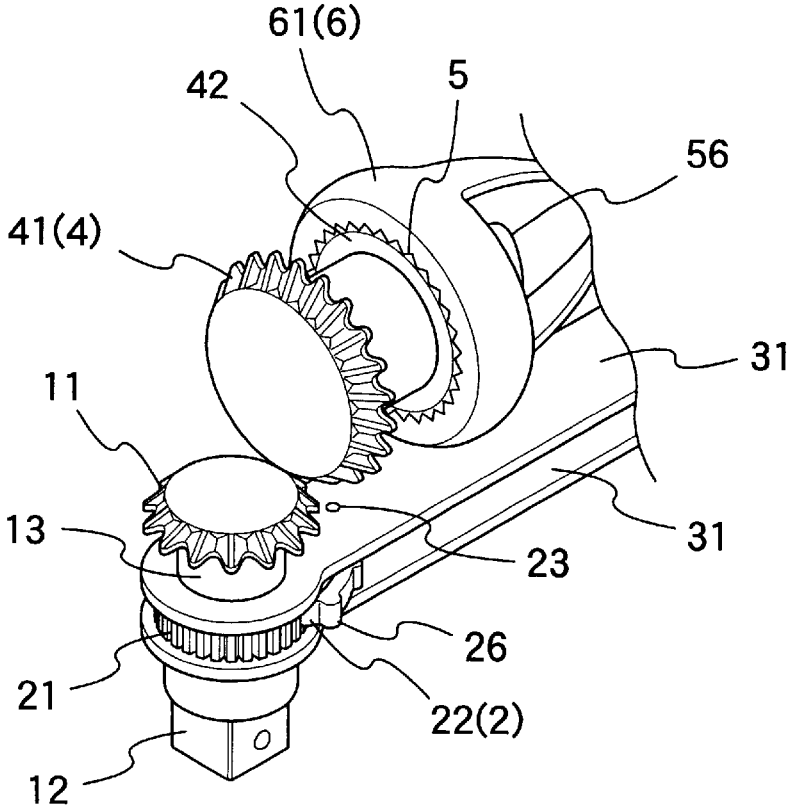
FIG. 7 is an enlarged perspective view showing bevel wheels and components parts in the periphery thereof.

A pin 64 is fixed to the handle 6 at a position between the erected portion 33 and the gripping part 6*a*. Two projections 35 are fixed to the rear surface (base side of the handle 6) of the erected portion 33 such that the two projections 35 form a predetermined angle (120° in the embodiment 1) therebetween, as shown in FIG. 6. When the handle 6 is rotated, the pin 64 is locked by the projections 35 to allow the handle 6 to be rotated within a predetermined angle so that the handle 6 can be used conveniently.

As shown in FIG. 2, a hole 65 is formed on the gripping part 6*a* to allow the handle 6 to be rotated at a great force by means of a bar inserted through the hole 65, when it is necessary to tighten or loosen the screw part at a great force in a narrow space.

An example of a method of using the screw-rotating tool having the above-described construction will be described below. In tightening the screw part with the screw-rotating tool, initially, the socket part 8 suitable for the screw part is installed on the insertion part 12. Then, the change-over knobs 26 and 56 are set to one side (clockwise rotation side) to allow the bevel wheels 11 and 41 to rotate in only one direction respectively, as shown with the arrows of FIG. 1. Then, the screw part is fitted into the engaging portion 82 of the socket part 8.

Thereafter, it is only necessary to rotate (reciprocating motion) the handle 6 within a predetermined angle with a worker's wrist by gripping the gripping part 6a with one hand. Owing to the operation of the first ratchet mechanism 2 and the second ratchet mechanism 5, the main rotary body 1 (socket part 8) rotates in the direction shown with the arrow of FIG. 1, thus tightening the screw part.

When the gripping part 6*a* is rotated in the direction shown with the thick black arrow of FIG. 1 with the wrist, the pawl 521 engages the ratchet wheel 51, thus transmitting the rotary motion of the gripping part 6*a* to the auxiliary rotary body 4. Thus, the auxiliary rotary body 4 rotates in the direction shown by the thick black arrow of FIG. 1, together with the handle 6. At this time, the bevel wheel 41 engages the bevel wheel 11, thus rotating the main rotary body 1 in the direction shown by the arrow of FIG. 1. When the bevel wheel 41 is rotating in receipt of the rotation of the auxiliary rotary body 4, the click 22 of the first ratchet mechanism 2 slides on the tooth surface 211 of the ratchet wheel 21. On the other hand, when the gripping part 6*a* is rotated (return operation) in the direction shown with the white arrow of FIG. 1, the pawl 521 of the second ratchet mechanism 5 slides on the tooth surface of the ratchet wheel 51. Thus, the handle 6 idles, with the auxiliary rotary body 4 being stationary. If the auxiliary rotary body 4 were to follow the rotation of the handle 6, the click 22 of the main section (A) locks the ratchet wheel 21, thus preventing the main rotary body 1 from rotating and hence the auxiliary rotary body 4. Accordingly, when the resistance between the screw part fitted into the socket part 8 and a female screw engaging the screw part becomes low, the frame 3 and the main rotary body 1 are stationary in the handle-returning operation. Thus, the screw part fitted into the socket part 8 is stationary. Thus, it never occurs that the screw part follows the idling of the handle 6.

As described above, the screw part can be rotated in a tightening direction reliably by rotating the gripping part 6*a* with the wrist at a predetermined angle. Further, the number of teeth of the bevel wheel 41 of the auxiliary rotary body 4 is set larger than that of the bevel wheel 11. Thus, only a slight amount of rotation of the handle gripping part 6*a* allows the main rotary body 1 to rotate at a high speed at the ratio of the number of teeth of the bevel wheel 41 to the number of teeth of the bevel wheel 11. That is, it is possible to tighten the screw part quickly on the female screw.

At the final stage, i.e., when it is necessary to tighten the screw part at a great force, as shown in FIG. 5, the handle 6 is pulled in the direction shown with the white arrow against the urging force of the compression coil spring (m). As a result, the distance between the rotational axis of the main rotary body 1 and the gripping part 6*a* increases by the distance (L). In this state, the gripping part 6*a* is pivoted on the rotational axis of the main rotary body 1 toward the worker, as shown with the black arrow of FIG. 5. Consequently, the torque becomes large, which allows the screw part to be tightened reliably at a small force.

When the screw part is loosened, the change-over knobs 26 and 56 are set to the other side (counterclockwise rotation side). Then, an operation similar to the above-described operation is performed to rotate the bevel wheels 11 and 41 in the direction reverse to the direction shown with the arrows of FIG. 1. In this manner, the screw part can be loosened easily.

(2) Embodiment 2

Figure 8:
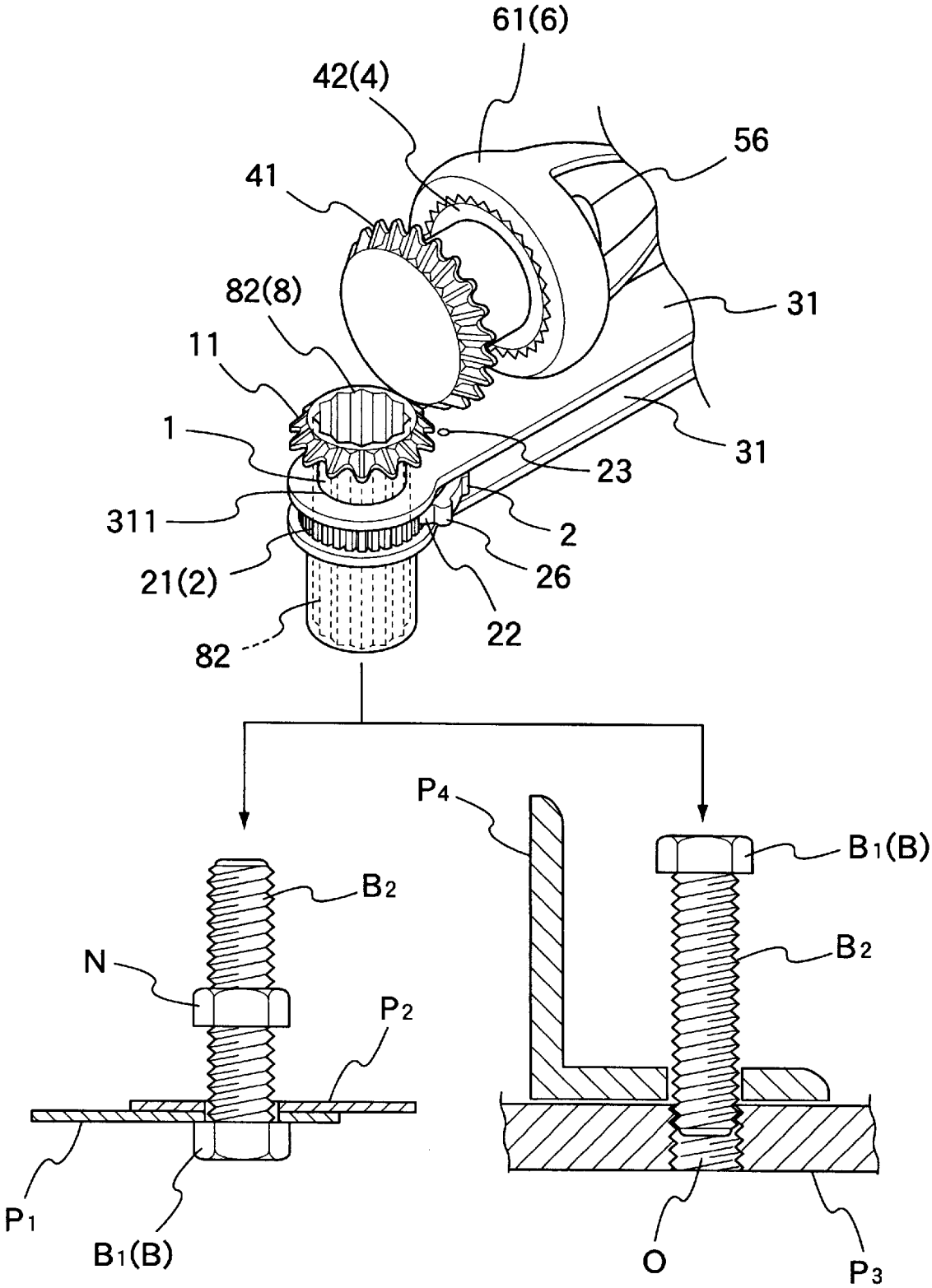
FIG. 8 is a partly enlarged perspective view showing a screw-rotating tool of an embodiment 2 of the present invention.

In the screw-rotating tool of the embodiment 2, as shown in FIG. 8, the hollow long socket part 8 is formed integrally with the main rotary body 1.

Owing to the hollow long socket part 8, when a plate $P_2$ is fastened with a stud bolt $B_2$ welded to a plate $P_1$ it is possible to secure the state in which the stud bolt $B_2$ is kept in penetration through the socket part 8 of the main rotary body 1. Thus, it is possible to continuously tighten a nut (N) from an initial stage through a final stage. Needless to say, it is possible to remove the nut (N) from the stud bolt $B_2$ by switching the position of the change-over knobs 26 and 56 from one side to the other side or vice versa. In fixing an L type steel $P_4$ to a base material $P_3$ having a screw part hole (O) formed thereon, a bolt head $B_1$ can be locked to the engaging portion 82 of the socket part 8. Thus, it is easy to tighten or loosen the stud bolt $B_2$.

The other constructions of the screw-rotating tool of the embodiment 2 are similar to those of the screw-rotating tool of the embodiment 1. Thus, the descriptions of the other constructions of the screw-rotating tool of the embodiment 2 are omitted herein. The component parts of the embodiment 2 same as those of the embodiment 1 are denoted by the reference numerals and symbols of the embodiment 1.

(3) Embodiment 3

Figure 9:
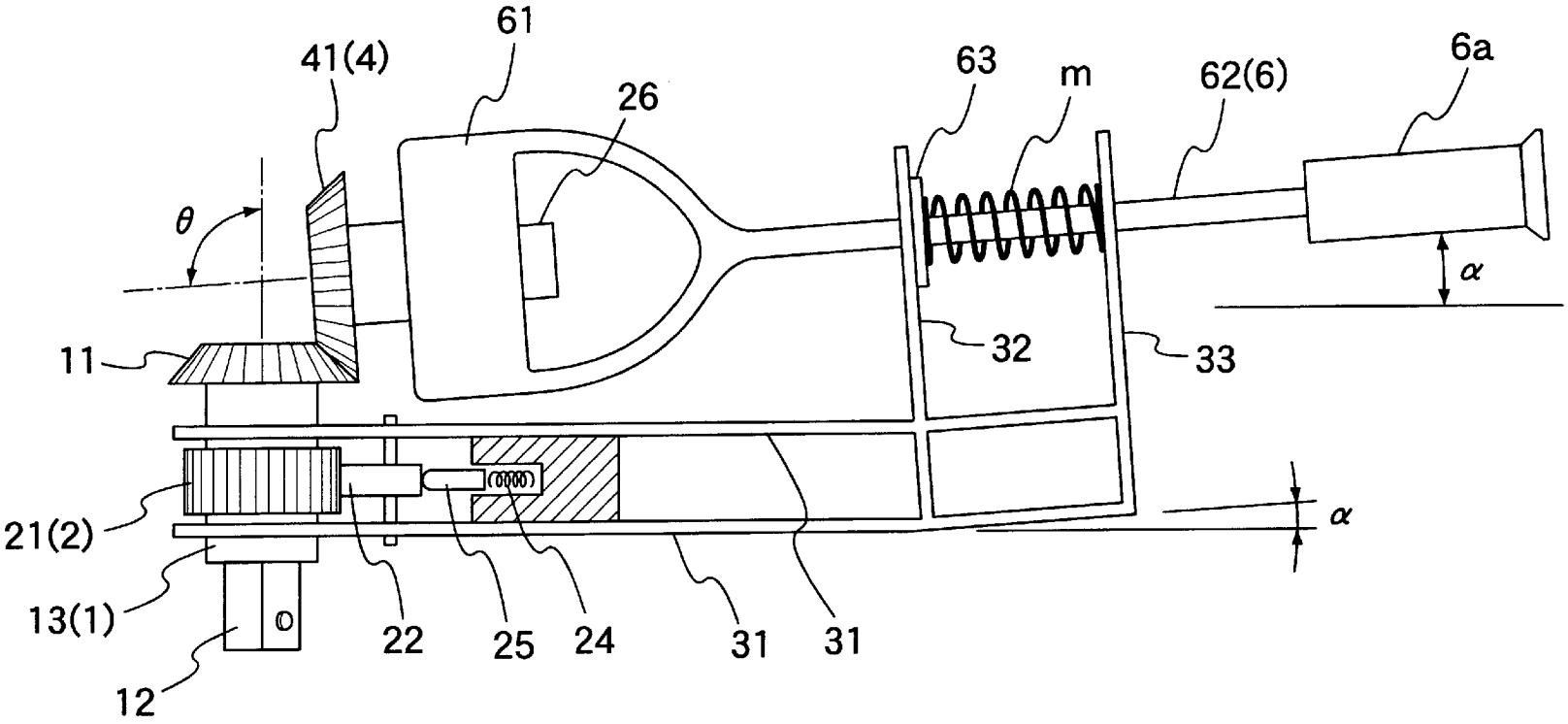
FIG. 9 is a front view partly in section showing a screw-rotating tool of an embodiment 3 of the present invention.

As shown in FIG. 9, in the screw-rotating tool of the embodiment 3, the intersection angle 6 of the rotational axis of the main rotary body 1 and that of the auxiliary rotary body 4 is set larger than 90°. Thus, the bevel wheel 11 of the main rotary body 1 and the bevel wheel 41 of the auxiliary rotary body 4 engage each other at the intersection angle θ.

More specifically, the shaft part 62 of the handle 6 of the embodiment 1 is inclined upward at an angle α with respect to the plate member 31 to make the intersection angle θ larger than 90°. Hence, the handle 6 can be operated with ease. The shaft part 62 is inclined upward at the angle α by bending the frame 3 of the embodiment 1 at the angle α with respect to the plate member 31 at a rear portion thereof. In the embodiment 2, the projection 35 and the pin 64 are not formed.

The other constructions of the screw-rotating tool of the embodiment 3 are similar to those of the screw-rotating tool of the embodiment 1. Thus, the descriptions of the other constructions of the screw-rotating tool of the embodiment 3 are omitted herein. The component parts of the embodiment 3 same as those of the embodiment 1 are denoted by the reference numerals and symbols of the embodiment 1.

(4) Embodiment 4

Figure 10:
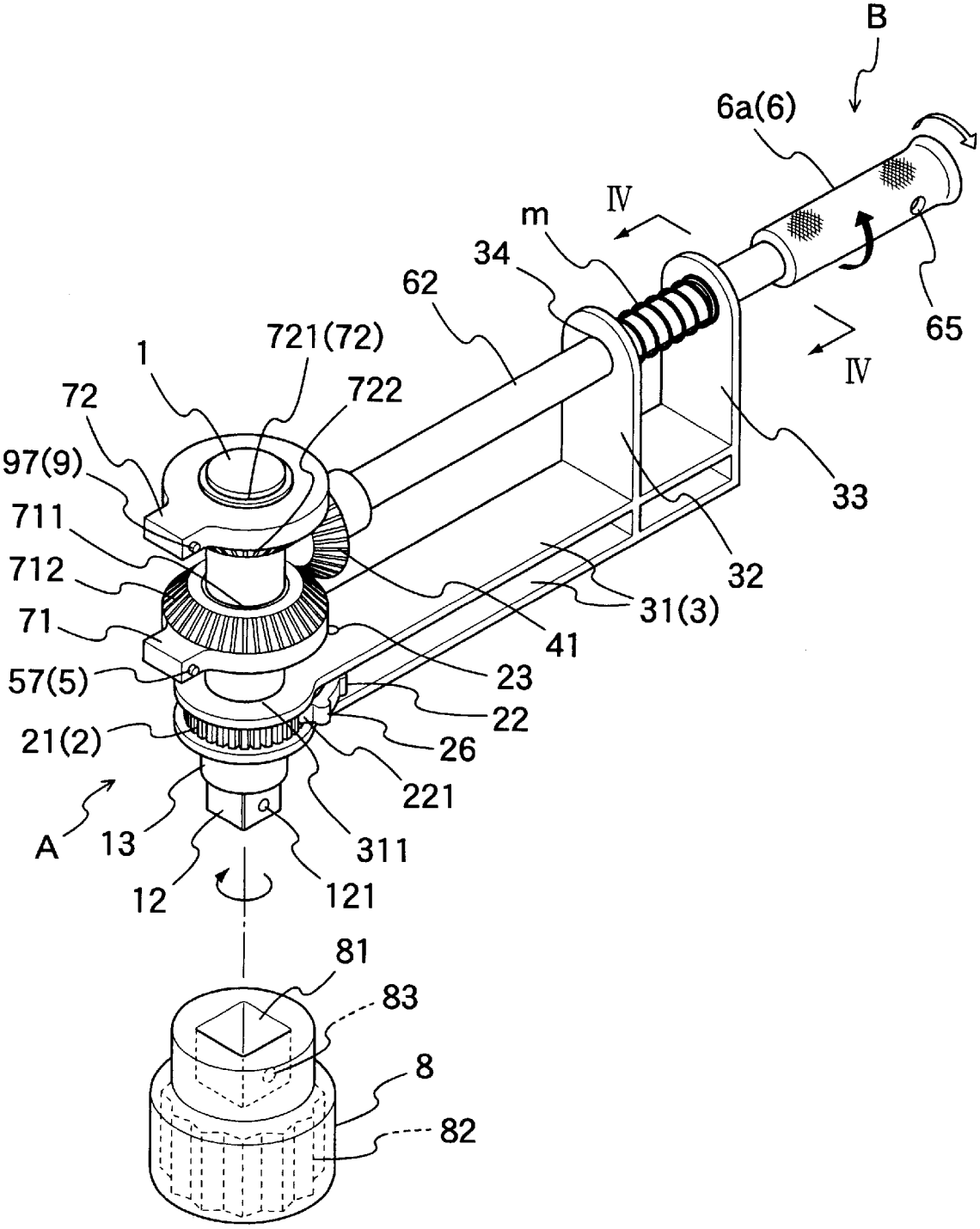
FIG. 10 is a perspective view showing a screw-rotating tool of an embodiment 4 of the present invention.
Figure 11:
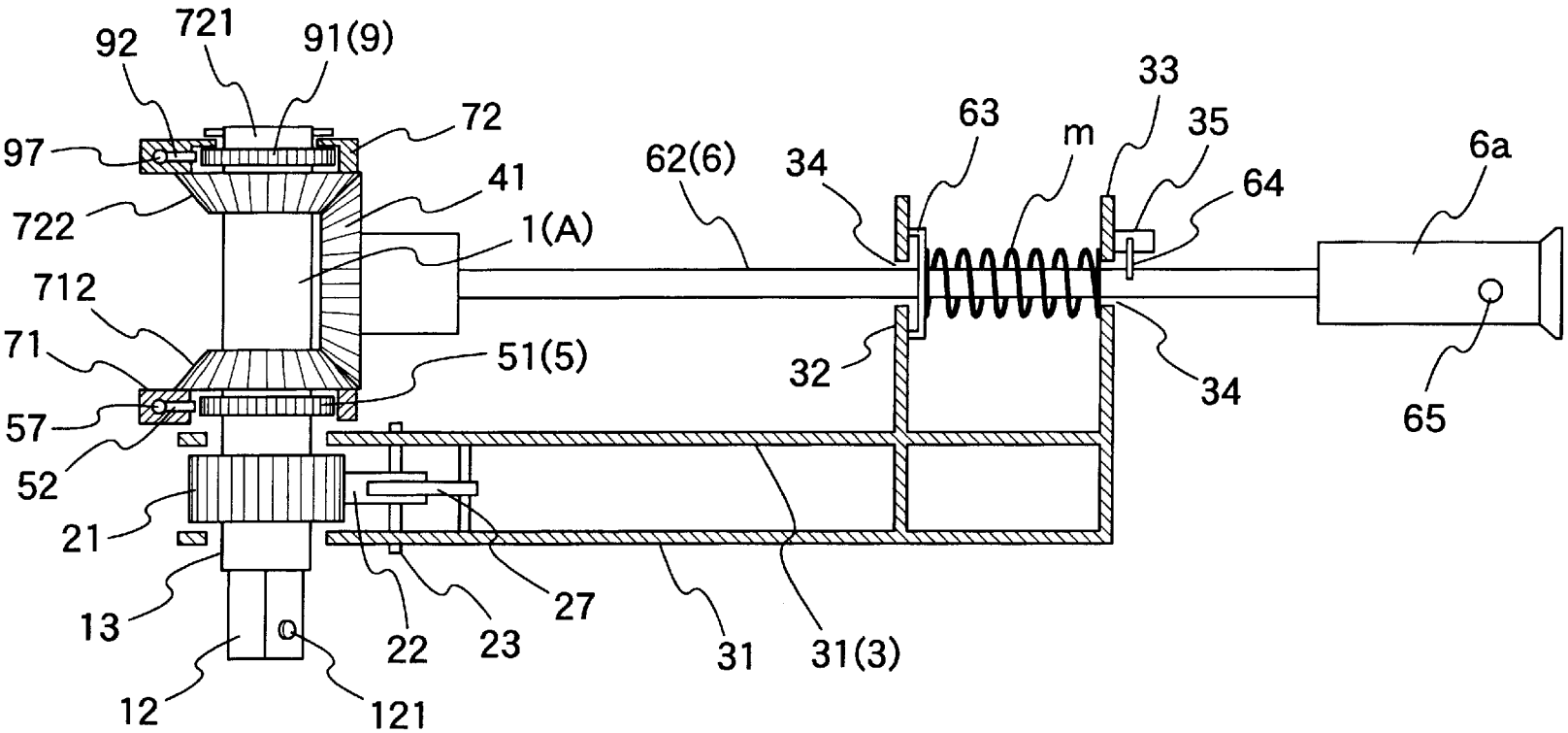
FIG. 11 is a front view partly in section showing the screw-rotating tool shown in FIG. 10.
Figure 12:
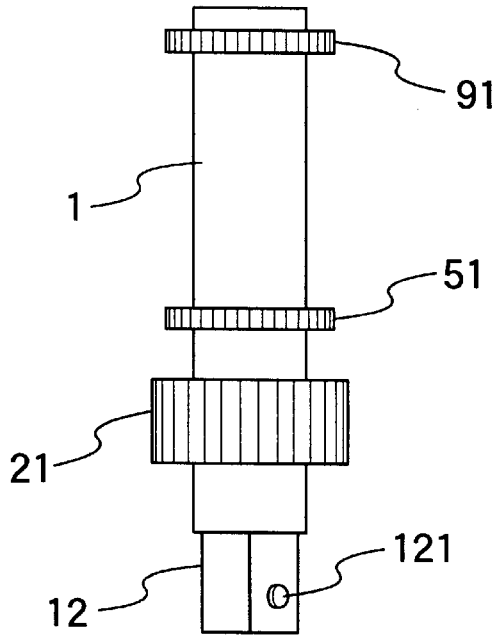
FIG. 12 is a front view showing a main rotary body shown in FIG. 10 and a ratchet wheel of each of first, second, and third ratchet mechanisms integral with the main rotary body.

Although the auxiliary rotary body 4 of the screwrotating tool of the embodiments 1–3 is coaxial with the handle 6, as shown in FIGS. 10–12, the screw-rotating tool of the embodiment 4 does not have the auxiliary rotary body 4. Instead, the screw-rotating tool of the embodiment 4 has an annular member 71 corresponding to the auxiliary rotary body 4 and coaxial with the main rotary body 1. The screw-rotating tool has the second ratchet mechanism 5 and a third ratchet mechanism 9 spaced at a predetermined interval from the first ratchet mechanism 2, respectively. The second ratchet mechanism 5 and the third ratchet mechanism 9 serve as the reverse rotation prevention mechanisms and are coaxial with the main rotary body 1.

The main section (A) comprises the main rotary body 1, the first ratchet mechanism 2, the second ratchet mechanism 5, and the third ratchet mechanism 9. The auxiliary section (B) comprises the handle 6. The shaft part 62 of the handle 6 is inserted through the frame 3 supporting the main rotary body 1.

Similarly to the embodiment 1, the square pillar-shaped insertion part 12 is formed at one end of the columnar main rotary body 1. The socket part 8 engaging the screw part can be fixedly installed on the insertion part 12. As shown in FIG. 12, the ratchet wheel 21 of the first ratchet mechanism 2 is fixed to the periphery of the drum part of the main rotary body 1. A pair of the plate members 31 and 31 of the frame 3 sandwiching the ratchet wheel 21 of the first ratchet mechanism 2 supports the main rotary body 1. A supporting shaft 23 (see FIG. 11) of the click 22 is installed on the plate members 31 to allow the first ratchet mechanism 2 to operate. The first ratchet mechanism 2 of the embodiment 4 has the same construction as that of the first ratchet mechanism 2 of the embodiment 1. Thus, the description of the first ratchet mechanism 2 of the embodiment 4 is omitted herein. The shaft part 62 of the auxiliary section (B) is inserted through the hole 34 formed on an upper portion of each of the erected portions 32 and 33 formed in the rear part (base side) of the frame 3.

In the embodiment 4, as shown in FIG. 12, the ratchet wheel 51 of the second ratchet mechanism 5 and a ratchet wheel 91 of the third ratchet mechanism 9 are formed integrally with the periphery of the drum part of the main rotary body 1. The ratchet wheels 51 and 91 are spaced at a predetermined interval, respectively from the ratchet wheel 21. The annular member 71 having a circular hole 711 formed thereon is installed on the periphery of the second ratchet wheel 51. The click 52 engaging the second ratchet wheel 51 is installed on the annular member 71. Because the basic construction of the second ratchet mechanism 5 is similar to that of the first ratchet mechanism 2, the description thereof is omitted herein. The change-over knob 26 is replaced with a change-over button 57 which allows switching of the rotational direction of the ratchet wheel 51. A bevel wheel 712 is fixed to the upper surface of the annular member 71.

Figure 13A:
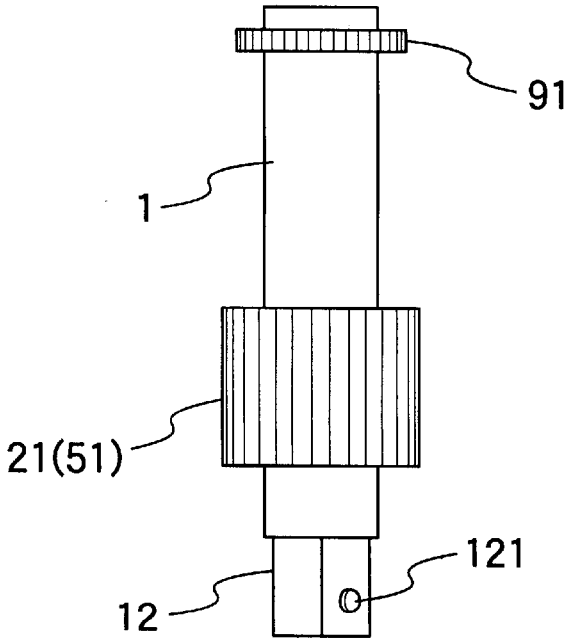
FIGS. 13A and 13B are front views each showing the ratchet wheel of each of the first, second, and third ratchet mechanisms having a mode different from that shown in FIG. 12.
Figure 13B:
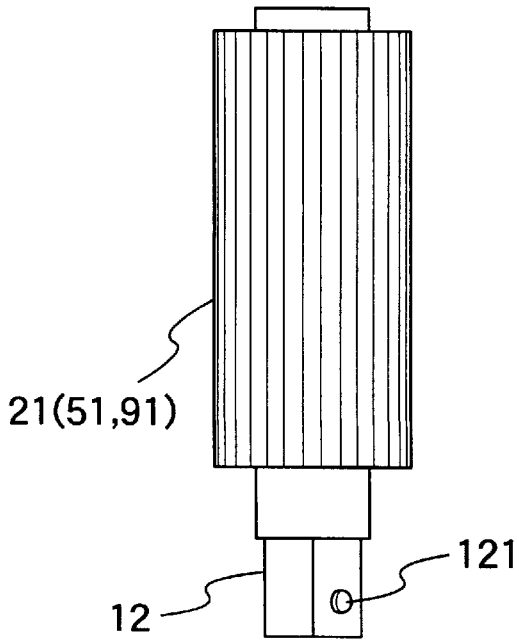

An annular member 72 having a circular hole 721 formed thereon is installed on the periphery of the third ratchet wheel 91. A click 92 engaging the third ratchet wheel 91 is installed on the annular member 72. A change-over button 97 allows switching of the rotational direction of the ratchet wheel 91. The basic construction of the third ratchet mechanism 9 is similar to that of the second ratchet mechanism 5. But unlike the annular member 71 of the second ratchet mechanism 5, a bevel wheel 722 is fixed to the lower surface of the annular member 72 of the third ratchet mechanism 9. For cost reduction, it is possible to form the ratchet wheel 21 of the first ratchet mechanism 2 integrally with the ratchet wheel 51 of the second ratchet mechanism 5, as shown in FIG. 13A. It is also possible to form the ratchet wheel 21 of the first ratchet mechanism 2, the ratchet wheel 51 of the second ratchet mechanism 5, and the ratchet wheel 91 of the third ratchet mechanism 9 integrally with one another, as shown in FIG. 13B.

As shown in FIG. 11, the bevel wheel 41 formed at the front end of the shaft part 62 engages the bevel wheels 712 and 722 to allow the engagement of the handle 6 with the second ratchet mechanism 5 and with the third ratchet mechanism 9 spaced at a predetermined interval from the second ratchet mechanism 5. The extension direction of the rotational axis of the handle 6 is set to be different from that of the main rotary body 1. In the embodiment 4, the rotational axis of the handle 6 extends perpendicularly to that of the main rotary body 1. The screw-rotating tool of the embodiment 4 comprises the main rotary body 1 having the socket part 8 formed at one end thereof and engaging the screw part; the second reverse rotation prevention mechanism 5 and the third reverse rotation prevention mechanism 9 both positioned in the axial direction of the main rotary body 1; and the handle 6 having the shaft part 62 inserted through the frame 3 supporting the main rotary body 1 to allow the engagement of the front end of the shaft part 62 with the second reverse rotation prevention mechanism 5 and with the third reverse rotation prevention mechanism 9. The screw part engaging the socket part 8 can be rotated in one direction by operating the handle 6. In the embodiment 4, the bevel wheel 41 serving as the rotation transmission mechanism engages the bevel wheels 712 and 722, thus transmitting the rotation of the gripping part 6*a* to the main rotary body 1. But other engaging members can be used provided that the screw part engaging the socket part 8 can be rotated in one direction by operating the handle 6, with the handle 6 in engagement with the second reverse rotation prevention mechanism 5 and with the third reverse rotation prevention mechanism 9.

The other constructions of the screw-rotating tool of the embodiment 4 are similar to those of the screw-rotating tool of the embodiment 1. Thus, the descriptions of the other constructions of the screw-rotating tool of the embodiment 4 are omitted herein. The component parts of the embodiment 4 same as those of the embodiment 1 are denoted by the reference numerals and symbols of the embodiment 1.

In the embodiment 4, it is possible to omit the provision of the first ratchet mechanism 2. In this case, the frame 3 supports the main rotary body 1 rotatably, instead of the first ratchet mechanism 2. It is also possible to omit the provision of the second ratchet mechanism 5 or the third ratchet mechanism 9. In this case, the effect of the embodiment 4 is similar to that of the embodiment 1.

(5) Embodiment 5

Figure 14:
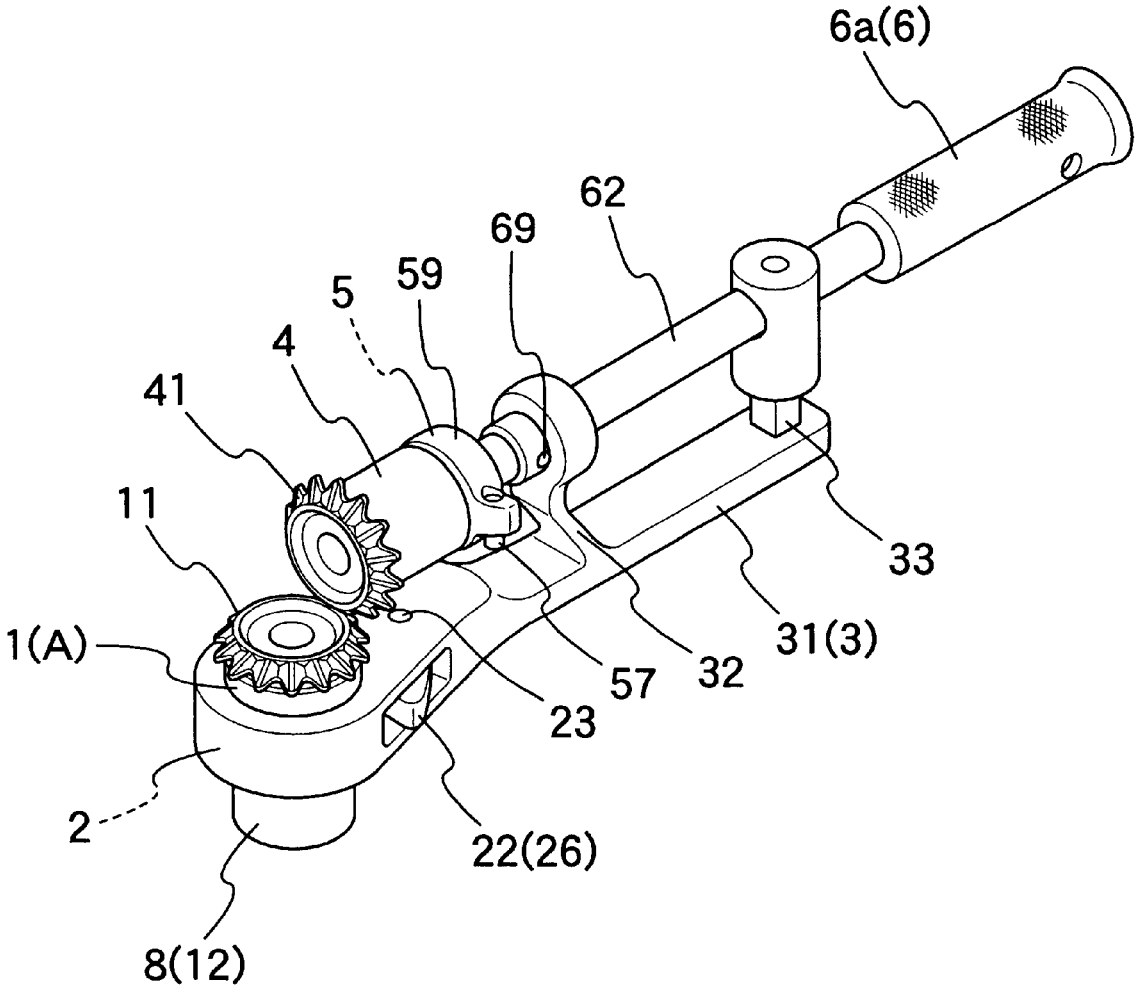
FIG. 14 is a perspective view showing a screw-rotating tool of an embodiment 5 of the present invention.

Referring to FIG. 14, the screw-rotating tool of the embodiment 5 is similar to that of the embodiment 1. That is, the screw-rotating tool comprises the frame 3 supporting the main rotary body 1 rotatably; the first ratchet mechanism 2 serving as the first reverse rotation prevention mechanism formed on the periphery of the main rotary body 1 to limit the rotational direction of the main rotary body 1 to either the clockwise or counterclockwise rotational direction; the shaft part 62 (handle 6) rotatably supported by the frame 3 such that the extension direction of the rotational axis of the shaft part 62 is different from that of the rotational axis of the main rotary body 1; the rotation transmission mechanisms 41 and 11 transmitting the rotation of the shaft part 62 to the main rotary body 1; and the second ratchet mechanism 5 serving as the second reverse rotation prevention mechanism limiting the clockwise and counterclockwise rotations of the handle shaft 62 to the clockwise or counterclockwise rotation of the main rotary body 1 set by the first ratchet mechanism 2 when the rotation of the handle shaft 62 is transmitted to the main rotary body 1. The construction comprising the main rotary body 1 excluding the bevel wheel 11, the socket part 8, the first ratchet mechanism 2, and the plate member 31 extending horizontally from the first ratchet mechanism 2 is similar to the known screw-rotating tool. That is, the construction is similar to the screw-rotating tool commercially available. The second ratchet mechanism 5 of the embodiment 5 is the same as that of the embodiment 4, thus having the change-over button 57. The erected portions 32 and 33 correspond to those of the embodiment 1. The socket part 8 is formed integrally with the main rotary body 1. A small projection 69 prevents the shaft part 62 from being dislocated rearward, namely, to the right side in FIG. 14 to reliably keep the bevel wheel 41 in contact with the bevel wheel 11. The auxiliary rotary body 4 including the bevel wheel 41 and an annular member 59 having the change-over button 57 (and click) of the second ratchet mechanism 5 installed thereon are fixed to each other. The main rotary body 1, the auxiliary rotary body 4, and the handle 6 can be operated independently of each other. The other constructions of the screw-rotating tool of the embodiment 5 are similar to those of the screw-rotating tool of the embodiment 1. Thus, the descriptions of the other constructions of the screw-rotating tool of the embodiment 4 are omitted herein. The component parts of the embodiment 5 same as those of the embodiment 1 are denoted by the reference numerals and symbols of the embodiment 1.

The screw-rotating tool is used as follows: When the handle 6 is rotated in one direction (reciprocating motion) within a certain angle by setting the change-over knob 26 and the change-over button 57 to one side (clockwise rotation), the click of the second ratchet mechanism 5 engages the ratchet wheel, and the auxiliary rotary body 4 is interlocked with the handle shaft 62, thus rotating the bevel wheel 11. At this time, the click 22 of the first ratchet mechanism 2 slides on the ratchet wheel and hence the main rotary body 1, namely, the socket part 8 rotate clockwise, thus tightening the screw part. In the rotation of the handle 6 in the other direction, the click of the second ratchet mechanism 5 slides on the ratchet wheel, thus idling the handle 6. Thus, the auxiliary rotary body 4 is stationary because the rotary motion of the handle 6 is not transmitted thereto. At this time, the click 22 of the first ratchet mechanism 2 engages the ratchet wheel, thus preventing the main rotary body 1 (socket part 8) from rotating reversely (counterclockwise). When the handle 6 is rotated within a certain angle by setting the change-over knob 26 and the change-over button 57 to the other side (counterclockwise rotation), an action reverse to the above-described action works. That is, the screw part is loosened.

(6) Embodiment 6

Figure 15:
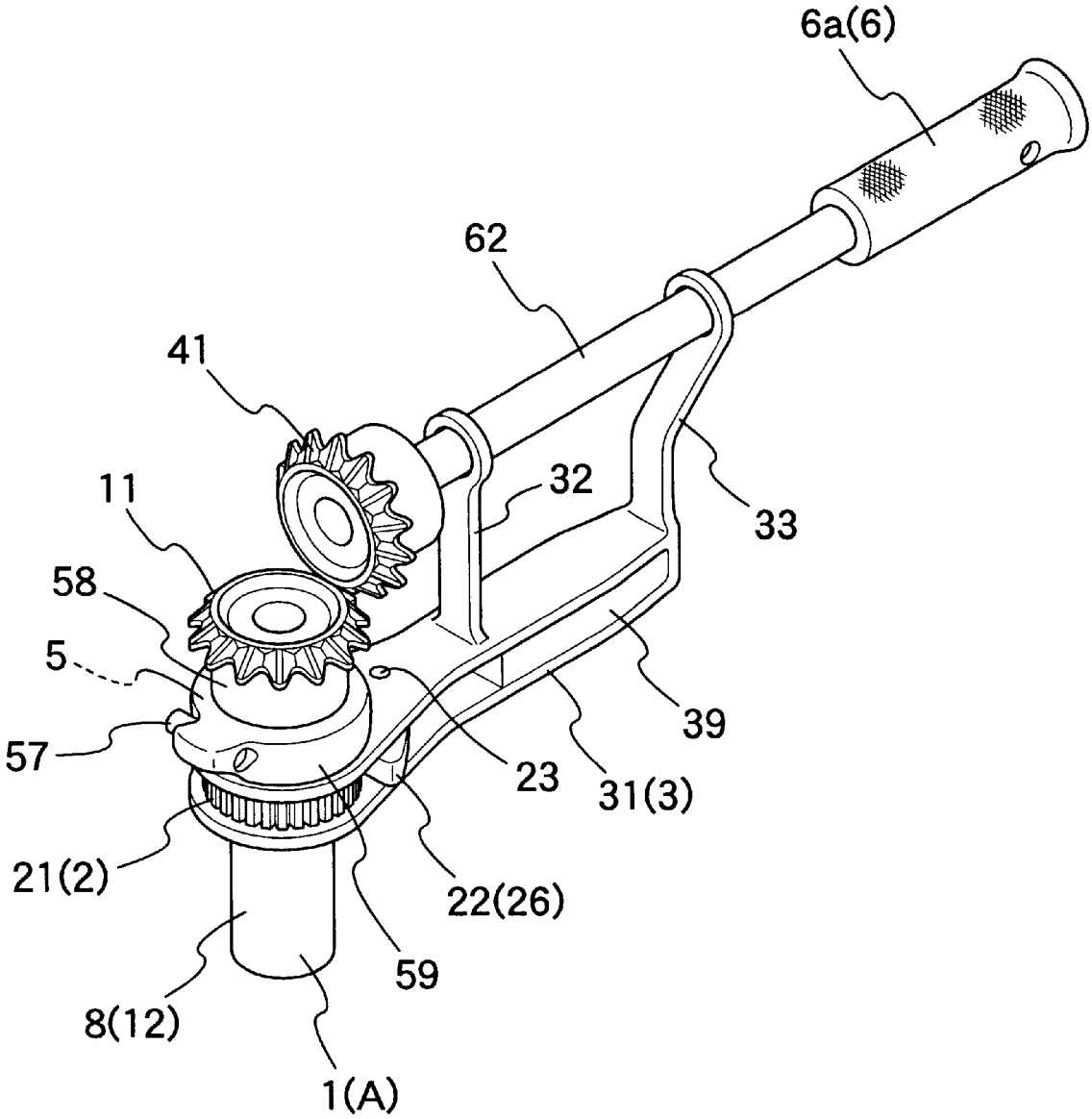
FIG. 15 is a perspective view showing a screw-rotating tool of an embodiment 6 of the present invention.

As shown in FIG. 15, the screw-rotating tool of the embodiment 6 is similar to that of the embodiment 4 except that the former does not include the third ratchet mechanism 9. The frame 3 rotatably supports the main rotary body 1 having the socket part 8 formed at one end thereof. The first ratchet mechanism 2 serving as the first reverse rotation prevention mechanism is formed on the periphery of the main rotary body 1 to limit the rotational direction of the main rotary body 1 to either the clockwise or counterclockwise rotational direction. The handle 6 is rotatably supported by the frame 3 such that the extension direction of the rotational axis of the handle 6 is different from that of the rotational axis of the main rotary body 1. The screw-rotating tool comprises the rotation transmission mechanisms 41 and 11 transmitting the rotation of the handle 6 to the main rotary body 1. There is provided on an upper portion of the main rotary body 1 the second ratchet mechanism 5 serving as the second reverse rotation prevention mechanism limiting the rotational direction (clockwise and counterclockwise) of the handle shaft 62 to the rotational direction (clockwise or counterclockwise) of the main rotary body 1 set by the first reverse rotation prevention mechanism 2 when the rotation of the handle 6 is transmitted to the main rotary body 1. In the embodiments 1 and 5, the auxiliary rotary body 4 is coaxial with the handle 6, whereas in the embodiment 6, a cylindrical portion 58 and the annular member 59 both replacing the auxiliary rotary body 4 of the embodiments 1 and 5 are coaxial with the main rotary body 1.

The construction comprising the socket part 8, the first ratchet mechanism 2, and the plate member 31 extending horizontally from the first ratchet mechanism 2 is formed by utilizing the construction of the conventional screw-rotating tool. The second ratchet mechanism 5 is also formed by modifying the head of the known screw-rotating tool having the change-over button 57. The bevel wheel 41 and the shaft part 62 are fixed to each other. The bevel wheel 11, the annular member 59 on which the change-over button 57 (and click) of the second ratchet mechanism 5 is installed, and the cylindrical portion 58 interposed between the bevel wheel 11 and the annular member 59 are fixed to one another. The ratchet wheel 21 of the first ratchet mechanism 2 and a ratchet wheel (not shown) of the second ratchet mechanism 5 are fixed to the periphery of the main rotary body 1 integral with the socket part 8. The main rotary body 1 and the annular member 59 are not fixed to each other but engage each other through the second ratchet mechanism 5. Reference numeral 39 denotes a spacer. The other constructions of the screw-rotating tool of the embodiment 6 are similar to those of the screw-rotating tool of the embodiment 4. Thus, the descriptions of the other constructions of the screw-rotating tool of the embodiment 6 are omitted herein. The component parts of the embodiment 6 same as those of the embodiment 4 are denoted by the reference numerals and symbols of the embodiment 4.

The screw-rotating tool is used as follows: When the handle 6 is rotated in one direction (reciprocating motion) within a certain angle by setting the change-over knob 26 and the change-over button 57 to one side (clockwise rotation), the click of the second ratchet mechanism 5 engages the ratchet wheel, which allows the bevel wheel 11, the annular member 59, and the main rotary body 1 to be interlocked with one another. At this time, the click of the first ratchet mechanism 2 slides on the ratchet wheel and hence the main rotary body 1, namely, the socket part 8 rotate clockwise, thus tightening the screw part. In the rotation of the handle 6 in the other direction, the click of the second ratchet mechanism 5 slides on the ratchet wheel, thus idling the bevel wheel 11, the cylindrical portion 58, and the annular member 59 when the bevel wheels 41 and 11 functioning as the rotation transmission mechanism rotate. At this time, the click 22 of the first ratchet mechanism 2 engages the ratchet wheel 21, thus preventing the main rotary body 1 (socket part 8) from rotating reversely (counterclockwise).

(7) Embodiment 7

Figure 16:
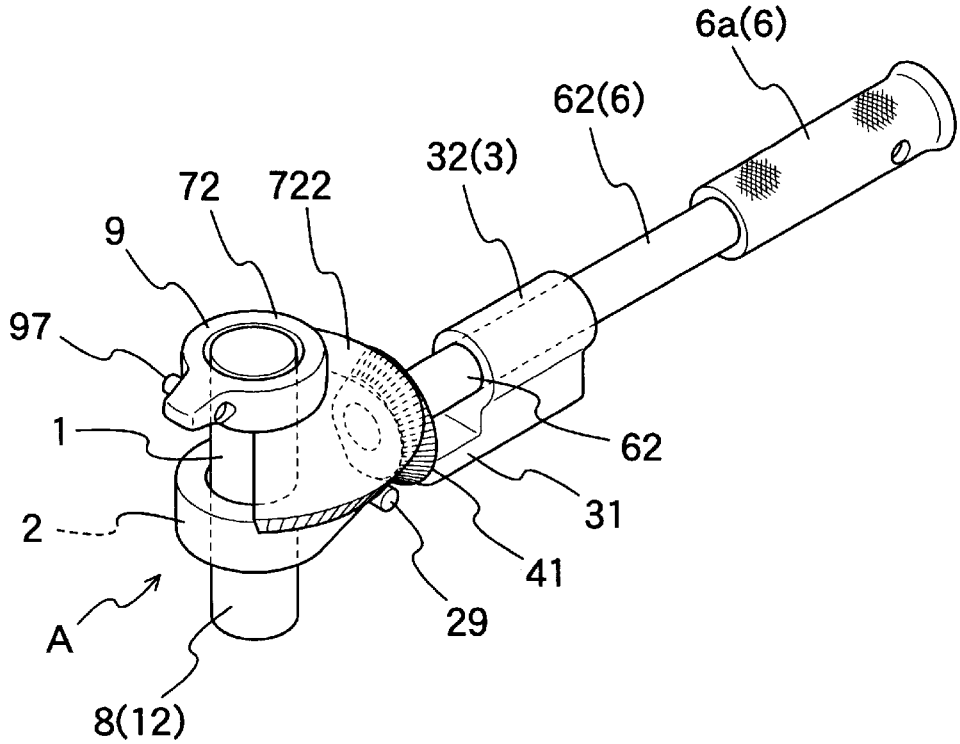
FIG. 16 is a perspective view showing a screw-rotating tool of an embodiment 7 of the present invention.

As shown in FIG. 16, the screw-rotating tool of the embodiment 7 is similar to that of the embodiment 4 except that the former does not include the second ratchet mechanism 5. The screw-rotating tool comprises the main section (A) having the first ratchet mechanism 2 formed on the periphery of the main rotary body 1 formed at one end of the socket part 8 engaging the screw part; the third ratchet mechanism 9 (the second ratchet mechanism 5 may be provided) provided in the axial direction of the main rotary body 1; and the handle 6 for operating the third ratchet mechanism 9 through the engaging members 41 and 722. The screw part engaging the socket part 8 is rotated in one direction by operating the handle 6.

The horizontal level of the shaft part 62 of the handle 6 is substantially coincident with that of the first ratchet mechanism 2. Thus, the shaft part 62 can be prevented from being shaken vertically in the last stage of tightening the screw part and in the initial stage of tightening the screw part temporarily. The engaging members 41 and 722 serving as the rotation transmission mechanism consist of semicircular bevel wheels that are not required to rotate 360°, and thus can be allowed to be compact. The erected portion 32 corresponds to that of the embodiment 4 shown in FIG. 10. A change-over button 29 of the click 22 corresponds to the change-over knob. The other constructions of the screw-rotating tool of the embodiment 7 are similar to those of the screw-rotating tool of the embodiment 4. Thus, the descriptions of the other constructions of the screw-rotating tool of the embodiment 7 are omitted herein. The component parts of the embodiment 7 same as those of the embodiment 4 are denoted by the reference numerals and symbols of the embodiment 4.

(8) Embodiment 8

Figure 17:
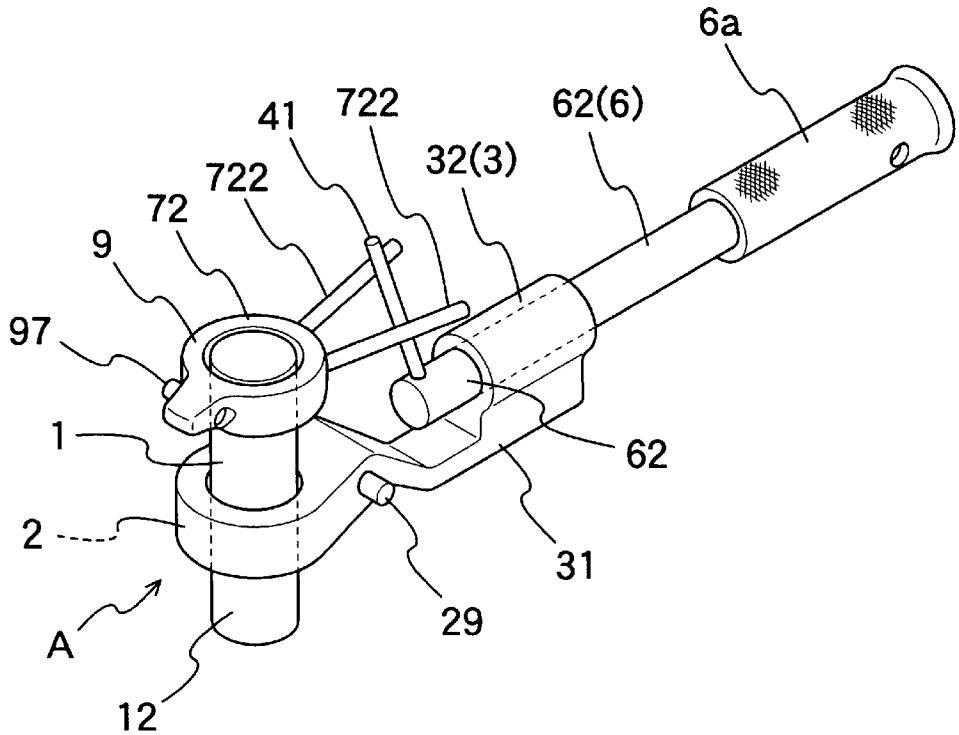
FIG. 17 is a perspective view showing a screw-rotating tool of an embodiment 8 of the present invention.

The screw-rotating tool of the embodiment 8 is as shown in FIG. 17. That is, the engaging members 41 and 722 of the embodiment 7 are replaced with a rod member, respectively. The rod member 41 is erected on the front end of the shaft part 62. The rod member 41 is sandwiched between the two rod members 722 projecting horizontally from the annular member 72 of the third ratchet mechanism 9 such that the rod member 41 engages the two rod members 722. The annular member 72 can be rotated by operating the handle 6. Because the other constructions of the screw-rotating tool of the embodiment 8 are similar to those of the screw-rotating tool of the embodiment 7, the detailed description thereof is omitted herein.

(9) Embodiment 9

Figure 18:
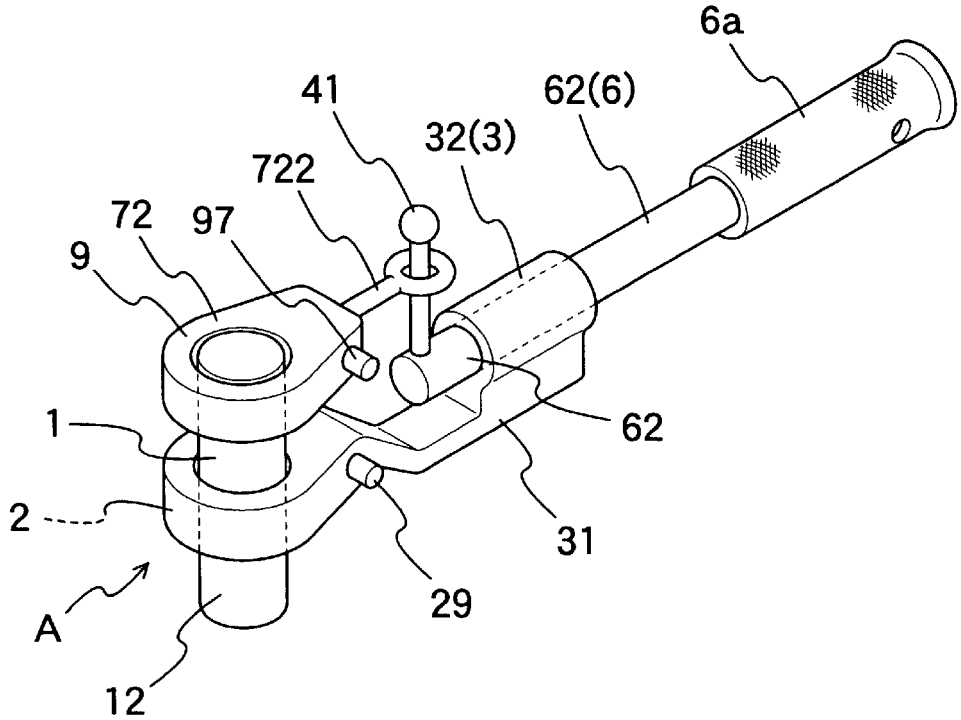
FIG. 18 is a perspective view showing a screw-rotating tool of an embodiment 9 of the present invention.

The screw-rotating tool of the embodiment 9 is as shown in FIG. 18. Instead of the two rod members 722 projecting horizontally from the annular member 72 of the embodiment 8, the engaging member 722 of the embodiment 9 has a ring at one end thereof. A rod member 41 of the shaft part 6 is inserted through the ring, with a space provided between the rod member 41 and the ring. When the handle 6 is rotated, the rod member 41 engages the rod member 722. The annular member 72 is rotated by operating the handle 6. Because the other constructions of the screw-rotating tool of the embodiment 9 are similar to those of the screw-rotating tool of the embodiment 8, the detailed description thereof is omitted herein.

(10) Effect of the Invention

Unlike the conventional screw-rotating tool, the screw-rotating tool of the present invention having the construction provides the following effects. When the resistance between a female portion of a screw part and a male portion thereof becomes small, the screw part does not rotate when the handle is rotated in a reverse direction. Thus, the screw part can be tightened or loosened without removing the screw-rotating tool from the screw part. The screw-rotating tool comprises the main section (A) having the first reverse rotation prevention mechanism provided on the periphery of the main rotary body; and the auxiliary section (B) including the auxiliary rotary body having the second reverse rotation prevention mechanism formed on the periphery thereof and engaging the main rotary body. The screw-rotating tool further comprises the handle which operates the second reverse rotation prevention mechanism. In this construction, the second reverse rotation prevention mechanism can be operated by rotating the handle, with the first reverse rotation prevention mechanism being stationary. Thus, when the resistance between the female portion of the screw part and the male portion thereof becomes small, the screw part does not rotate when the handle is rotated in a reverse direction and hence the screw part can be tightened or loosened reliably. Because the extension direction of the rotational axis of the main rotary body 1 is different from that of the rotational axis of the handle 6, the screw part does not rotate when the handle is rotated in a reverse direction.

The main rotary body 1 and the auxiliary rotary body 4 engage each other, with the extension direction of the rotational axis of the former and that of the rotational axis of the latter being different from each other. Thus, the gripping part 6*a* can be placed at a position where it can be easily handled. From the initial to the final stage of tightening or loosening the screw part, the gripping part 6*a* is merely rotated within a predetermined angle with the wrist, with a worker keeping one hand at the same portion of the gripping part 6*a*. Thus, the screw-rotating tool is very convenient to handle. In particular, the worker can keep the operation of tightening or loosen the screw part without disengaging the socket from the screw. Therefore, the screw-rotating tool can be very conveniently used by a scaffolding man in tightening or loosening large bolts and nuts at a dangerous high ground.

Figure 19:
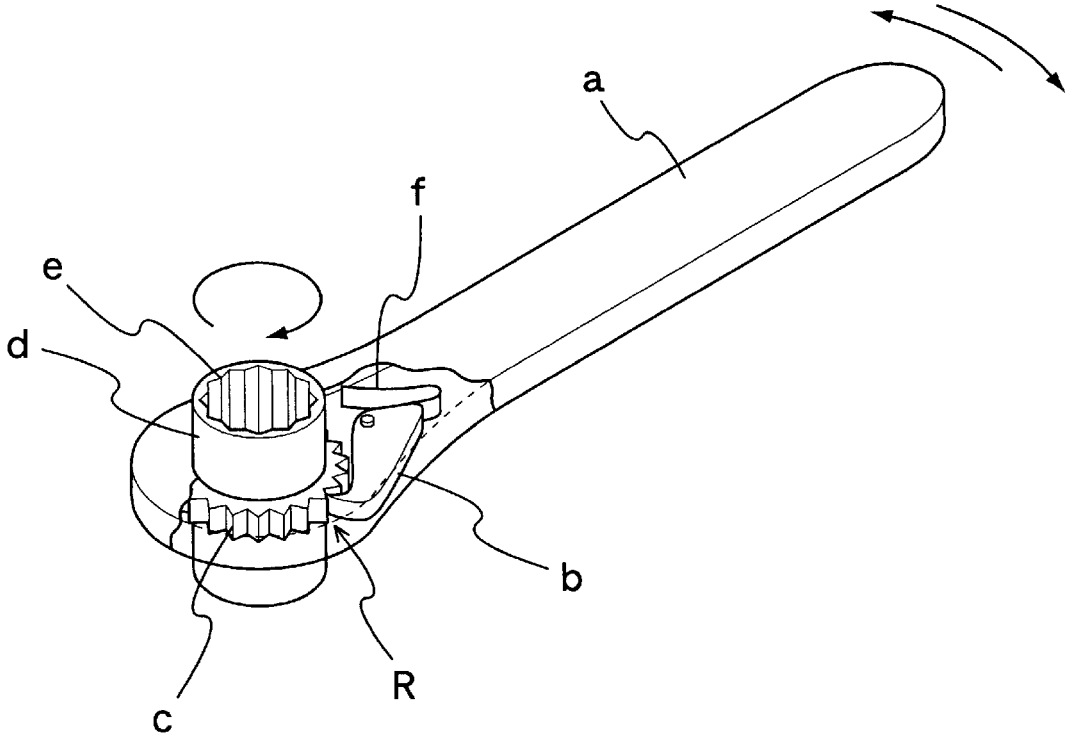
FIG.19 (PRIOR ART)
FIG. 19 is an explanatory view showing a conventional screw-rotating tool.

For example, at the initial stage of loosening a bolt $B_2$ which is a tightening material, a great torque can be generated by making the distance between the axis thereof (namely, the main rotary body 1) and the gripping part 6*a*, as shown in FIG. 5. Thus, the screw-rotating tool is capable of loosening the bolt tightened rigidly. Once the bolt is loosened, the gripping part 6*a* is merely rotated within a predetermined angle, with the bevel wheels 11 and 41 engaging each other. When the resistance between a female screw and a bolt becomes smaller than the resistance between the ratchet wheel of the ratchet mechanism and the click thereof, the main rotary body 1 becomes stationary or rotates in the bolt-loosening direction. More specifically, unlike the conventional screw-rotating tool, it does not occur that the rotational direction of the screw part is coincident with that of the main rotary body 1 (see arrow of FIG. 19). That is, the screw part is prevented from rotating when the handle is rotated in a reverse direction.

As described in the example of using the screw-rotating tool of the embodiment 1, the tightening operation can be accomplished favorably without the screw part rotating, when the handle is rotated in a reverse direction.

In addition, because the number of teeth of the bevel wheel 41 of the auxiliary section (B) is set larger than that of the bevel wheel 11 of the main section (A), the number of rotations of the main section (A) is allowed to be larger than that of the auxiliary section (B). Thus, in the situation in which the resistance between the female screw and the bolt is small, it is possible to accomplish the screw-rotating operation with high efficiency.

In the embodiment 2, the socket part 8 of the screw-rotating tool is hollow and long. Thus, the screw part $B_2$ axially long does not interfere with the screw-rotating tool. Thus, it is possible to tighten or loosen the screw parts $B_2$ and N (see FIG. 8) smoothly.

According to the embodiment 3, the angle of intersection of the rotational axis of the main rotary body 1 with that of the auxiliary rotary body 4 is set larger than 90°. In this case, the gripping part 6*a* inclines upward. Thus, it is easy to grip the gripping part 6*a*, which facilitates a screw-rotating work.

In the embodiment 4, the change-over button 57 of the second ratchet mechanism 5 for operating the ratchet wheel 51 and the change-over button 97 of the third ratchet mechanism 9 for operating the ratchet wheel 91 are set to one side (clockwise direction) and the other side (counterclockwise rotation), respectively. Then, the handle 6 is rotated clockwise and counterclockwise within a predetermined angle with the wrist. As a result, the main rotary body 1 tightens the screw part engaging the socket part 8 by both the clockwise and counterclockwise rotations of the handle 6. Thus, the screw-rotating tool of the embodiment 4 has a superior effect.

When the gripping part 6*a* is rotated with the wrist in the direction shown by the black arrow of FIG. 10, the bevel wheel 41 engages the bevel wheels 712 and 722. The bevel wheels 712 and 722 transmit the rotation of the bevel wheel 41 to the second and third ratchet mechanisms 5 and 9, respectively. In the second ratchet mechanism 5, the click 52 engages the ratchet wheel 51. Thereby, the rotary motion of the gripping part 6*a* is transmitted to the main rotary body 1. While the main rotary body 1 is rotating in the direction shown by the arrow of FIG. 10 in receipt of the second ratchet mechanism 5 (ratchet wheel 51), the click 22 of the first ratchet mechanism 2 slides on the tooth surface 211 of the ratchet wheel 21, and the click 92 of the third ratchet mechanism 9 also slides on the tooth surface of the ratchet wheel 91.

On the other hand, when the gripping part 6*a* is rotated in the direction shown by the white arrow of FIG. 10, the click 52 of the second ratchet mechanism 5 slides on the tooth surface of the ratchet wheel 51, and the click 92 of the third ratchet mechanism 9 engages the ratchet wheel 91. Thereby, the rotation of the gripping part 6*a* is transmitted to the main rotary body 1. As a result, the main rotary body 1 rotates in the direction shown by the arrow. At this time, the click 22 of the first ratchet mechanism 2 slides on the tooth surface 211 of the ratchet wheel 21.

The main rotary body 1, namely, the socket part 8 is rotated in the direction reverse to that shown by the arrow of FIG. 10 by reversing the setting position of the change-over knob 26, the change-over button 57, and the change-over button 97, respectively. Thus, the screw-rotating tool of the embodiment 4 can be used very conveniently to tighten or loosen the screw part.

In the screw-rotating tool of the embodiment 4, the screw part in engagement with the socket part 8 can be kept to be rotated in one direction by rotating the main rotary body 1 in the direction shown with the arrow of FIG. 10 in both clockwise and counterclockwise rotations of the handle 6. Consequently, the screw part can be tightened or loosened with high efficiency. It is possible to remove the first ratchet mechanism 2 from the screw-rotating tool. In this case, the screw-rotating tool does not have the safety locking function of rotating the main rotary body 1 in only one direction. But the embodiment 4 provides the substantial effect of rotating the main rotary body 1 in one direction by the reciprocating rotary motion of the handle 6. If the screw-rotating tool does not include the ratchet mechanism 5 or the third ratchet mechanism 9, the effect of the screw-rotating tool of the embodiment 4 is similar to that of the screw-rotating tool of the embodiment 1.

The screw-rotating tool of each of the embodiments 5 through 9 is similar to that of the embodiment 1, thus having the effect similar to that of the screw-rotating tool of the embodiment 1.

The screw-rotating tool of the embodiments of the present invention may be modified within the scope of the present invention, according to purpose and use. Depending on use, it is possible to select the shape, mechanism, and size of the main rotary body 1, the first ratchet mechanism 2, the frame 3, the auxiliary rotary body 4, the second ratchet mechanism 5, the handle 6, the compression coil spring (m), and the socket part 8.

For example, although the bevel wheel 11 is used as the engaging member in the embodiments, a universal joint or a flexible joint may be used instead as the engaging member, provided that they can transmit the rotary motion of the auxiliary rotary body 4 to the main rotary body 1.

As another example, the first, second, and third reverse rotation prevention mechanisms are not limited to the ratchet mechanisms of the embodiments. They may be replaced with mechanisms capable of rotating the main rotary body 1 and the auxiliary rotary body 4 in one direction. For example, the ratchet mechanisms of the embodiments may be replaced with those having no gears or with those of braking type.

The first and second ratchet mechanisms 2 and 5 may have the same construction or different from each other as shown in FIGS. 3 and 4. As the springs 24 and 54 urging the clicks 22 and 52, respectively, an elastic material such as a leaf spring may be used.

The screw part to be fitted in the engaging portion 82 of the socket part 8 is not limited to bolts and nuts described in the embodiments. The engaging portion 82 of the socket part 8 may be so concave that polygonal bolt heads or nuts can be fitted thereinto.

The engaging portion 82 of the socket part 8 may be convex. For example, it may be cross bitt-shaped, a minus bitt-shaped or a hexagon rod-shaped so that the screw-rotating tool can be applied to screw parts having concave engaging portions formed on their heads. The socket part 8 may be separate from the main rotary body 1, provided that it can be installed on the screw-rotating tool 1 when it is used.

The preferred embodiments described herein are therefore illustrative and not restrictive, the scope of the invention being indicated in the appended claims and all variations which come within the meaning of the claims and intended to be embraced therein.

What is claimed is:

1. A screw-rotating tool comprising:

a main section having a first reverse rotation prevention mechanism provided on a periphery of a main rotary body having a socket part which is formed on one end thereof and engaging a screw part; and an auxiliary section including an auxiliary rotary body having a second reverse rotation prevention mechanism formed on a periphery thereof and engaging said main rotary body and a handle which operates said second reverse rotation prevention mechanism, wherein said screw part engaging said socket part is rotated in one direction by operating said handle.

2. A screw-rotating tool according to claim 1, wherein said main rotary body and said auxiliary rotary body engage each other, with a rotational axis of said main rotary body and a rotational axis of said auxiliary rotary body extending in different directions.

3. A screw-rotating tool according to claim 1, wherein said main rotary body and said auxiliary rotary body engage through gears; and the number of teeth of said auxiliary rotary body and that of said main rotary body are different from each other.

4. A screw-rotating tool according to claim 1, wherein a shaft part of said handle is inserted through a frame supporting said main rotary body; and an elastic member urges said shaft part from a gripping part of said handle positioned at a rear end thereof toward said auxiliary rotary body provided at a front end thereof to engage said auxiliary rotary body with said main rotary body.

5. A screw-rotating tool comprising:

a frame rotatably supporting a main rotary body having a socket part formed on one end thereof and engaging a screw part;

a first reverse rotation prevention mechanism formed on a periphery of said main rotary body to limit both rotational directions of said main rotary body to one rotational direction;

a handle rotatably supported by said frame such that an extension direction of a rotational axis of said handle is different from that of a rotational axis of said main rotary body;

a rotation transmission mechanism transmitting a rotation of said handle to said main rotary body; and a second reverse rotation prevention mechanism for limiting both rotational directions of said handle shaft to a rotational direction of said main rotary body set by said first reverse rotation prevention mechanism, when the rotation of said handle is transmitted to said main rotary body.

6. A screw-rotating tool comprising:

a main rotary body having a socket part formed at one end thereof and engaging a screw part;

a second reverse rotation prevention mechanism and a third reverse rotation prevention mechanism both provided in an axial direction of said main rotary body; and a handle having a shaft part inserted through a frame supporting said main rotary body to engage a front end of said shaft part with said second reverse rotation prevention mechanism and said third reverse rotation prevention mechanism, wherein said screw part engaging said socket part can be rotated in one direction by operating said handle.

* * * * *